US007546700B2

(12) United States Patent
Westmont et al.

(10) Patent No.: US 7,546,700 B2
(45) Date of Patent: Jun. 16, 2009

(54) PISTE GROOMING APPARATUS FOR A MOTOR VEHICLE, IN PARTICULAR A TRACK-LAYING VEHICLE

(75) Inventors: Scott A. Westmont, Reno, NV (US); Franz Beer, Elchingen (DE); Gerd Friedmann, Ulm (DE); Hans-Martin Nusser, Neu-Ulm (DE)

(73) Assignee: Kaessbohrer Gelaendefahrzeug AG, Laupheim (DE)

( * ) Notice: Subject to any disclaimer, the term of this patent is extended or adjusted under 35 U.S.C. 154(b) by 0 days.

(21) Appl. No.: 11/986,020

(22) Filed: Nov. 19, 2007

(65) Prior Publication Data

US 2008/0184602 A1 Aug. 7, 2008

(30) Foreign Application Priority Data

Nov. 23, 2006 (DE) ..... 10 2006 057 272

(51) Int. Cl.
*E01H 5/04* (2006.01)

(52) U.S. Cl. ..... 37/223

(58) Field of Classification Search ..... 37/219–224, 37/236, 245, 247; 172/118, 122, 123, 112, 172/654, 684.8
See application file for complete search history.

(56) References Cited

U.S. PATENT DOCUMENTS

| | | | | |
|---|---|---|---|---|
| 4,523,398 A * | 6/1985 | Scheibel et al. | ..... | 37/220 |
| 4,718,183 A | 1/1988 | Haug | | |
| 4,738,037 A | 4/1988 | Haug | | |
| 4,888,891 A | 12/1989 | Haug | | |
| 5,067,263 A | 11/1991 | Pelletier | | |
| 5,659,984 A | 8/1997 | Haug | | |
| 5,809,671 A * | 9/1998 | Sinykin | ..... | 37/219 |
| 6,810,609 B2 * | 11/2004 | Lassonde et al. | ..... | 37/236 |

FOREIGN PATENT DOCUMENTS

| | | |
|---|---|---|
| DE | 79 32 781.4 | 9/1983 |
| DE | 85 28 096.8 | 11/1985 |
| DE | 41 01 617 A1 | 7/1991 |
| DE | 92 17 472.8 | 2/1993 |

(Continued)

OTHER PUBLICATIONS

Office Action of the Germany Patent Office dated Oct. 12, 2006 (3 pages).

(Continued)

*Primary Examiner*—Robert E Pezzuto
(74) *Attorney, Agent, or Firm*—Flynn, Thiel, Boutell & Tanis, P.C.

(57) ABSTRACT

A piste grooming apparatus for a motor vehicle, in particular a track-laying vehicle, includes a cutter support which can be adjusted relative to the motor vehicle about a plurality of axes and which has a cutting shaft arrangement that is arranged rotatably in an impact housing. A smoothing mechanism is arranged—as seen in the forward direction of travel of the motor vehicle—behind the cutting shaft arrangement and is held in an adjustable manner.

The impact housing and the cutting shaft arrangement are held on the cutter support in a manner such that they can be adjusted about a pivot axis which—as seen in the forward direction of travel of the motor vehicle—lies behind an axis of rotation of the cutting shaft arrangement.

5 Claims, 4 Drawing Sheets

FOREIGN PATENT DOCUMENTS

| | | | |
|---|---|---|---|
| DE | 296 00 905 | U1 | 5/1996 |
| DE | 297 03 678 | U1 | 6/1998 |
| DE | 20 2004 006 301 | U1 | 7/2004 |
| EP | 0 211 380 | | 2/1987 |
| EP | 0 648 899 | B1 | 4/1995 |
| EP | 0674734 | | 10/1995 |
| WO | WO 94/15028 | | 7/1994 |
| WO | WO 98/38388 | | 9/1998 |

OTHER PUBLICATIONS

Search Report of the Germany Patent Office dated Oct. 17, 2006 (4 pages).

Office Action of the Germany Patent Office dated Nov. 16, 2007 (3 pages).

* cited by examiner

PISTE GROOMING APPARATUS FOR A MOTOR VEHICLE, IN PARTICULAR A TRACK-LAYING VEHICLE

FIELD OF THE INVENTION

The invention relates to a piste grooming apparatus for a motor vehicle, in particular a track-laying vehicle, with a cutter support which can be adjusted relative to the motor vehicle about a plurality of axes and has a cutting shaft arrangement which is arranged rotatably in an impact housing, and with a smoothing mechanism which—as seen in the forward direction of travel of the motor vehicle—is arranged behind the cutting shaft arrangement and is held in an adjustable manner by means of at least one adjusting means.

BACKGROUND OF THE INVENTION

A piste grooming apparatus of this type is known from EP 0 674 734 B1. The known piste grooming apparatus is provided for rear attachment to a track-laying vehicle for grooming snow pistes. The known piste grooming apparatus is provided for attachment to the rear of a track-laying vehicle for grooming snow pistes. The piste grooming apparatus has a two-part cutting shaft arrangement which is accommodated in an impact housing which is likewise in two parts. The impact housing is arranged on a cutter support in the manner such that it can pivot about a pivot axis extending transversely with respect to the direction of travel in order to permit raising and lowering of the cutting shaft arrangement. The pivot axis for the impact housing and the cutting shaft arrangement is located—as seen in the normal direction of travel of the track-laying vehicle—in front of the cutting shaft arrangement, and therefore the cutting shaft arrangement and the impact housing are dragged by the cutter support and therefore also by the track-laying vehicle to which the cutter support is coupled. In addition, a smoothing mechanism is provided on the cutter support behind the cutting shaft arrangement—as seen in the normal direction of travel of the track laying vehicle, which smoothing mechanism can be changed in terms of how it rests on the snow surface by means of at least one adjusting cylinder.

It is the object of the invention to provide a piste grooming apparatus of the type mentioned at the beginning which enables the quality of the prepared piste surface to be further improved.

SUMMARY OF THE INVENTION

This object is achieved in that the impact housing and the cutting shaft arrangement are held on the cutter support in a manner such that they can be adjusted about a pivot axis which—as seen in the forward direction of travel of the motor vehicle—lies behind an axis of rotation of the cutting shaft arrangement. The solution according to the invention results in the cutting shaft arrangement being pushed and not dragged, as is the case in the prior art. The function of pushing the cutting shaft arrangement from the rear results in improved preparation of the piste surface, since the exerted push obtains a uniform contact pressure of cutting shaft arrangement and impact housing against the snow to be prepared. The smoothing mechanism remains in the same position irrespective of the cutting depth of the cutting shaft arrangement, since corresponding support and adjusting means for the smoothing mechanism are arranged on the cutter support. The solution according to the invention is suitable in a particularly advantageous manner for a configuration of the piste grooming apparatus as a rear mounted implement for a track-laying vehicle for grooming snow pistes. The adjustability of the smoothing mechanism ensures a sufficient and constant contact pressure behind the cutting shaft arrangement and therefore on the snow which has already been prepared and crushed. The pushed cutting shaft arrangement therefore brings about improved crushing of the snow and ice surface, and the support and adjusting means which act on the smoothing mechanism adjoining the rear side result in high-quality smoothing of the prepared quantities of snow and ice. The smoothing mechanism has a smoothing board which is also referred to as a finisher and can be of single- or multi-part design. The finisher is preferably of continuous design over the entire preparation width in order to obtain a uniformly prepared snow surface over the entire working width. As seen in the direction of travel, the finisher can be formed from at least two parts arranged one behind the other. In the case of such a multi-part design of the finisher, at least one finisher part is acted upon by the adjusting means. In addition, the piste grooming apparatus can be provided with side finishers which are arranged on both sides of the impact housing and smooth the lateral edges banked up during the driving mode of the track-laying vehicle. The cutting shaft arrangement can be a single, continuous cutting shaft or else can comprise a plurality of cutting shafts preferably arranged aligned next to one another. The last-mentioned case involves a multi-part cutting shaft arrangement, the former case involves a single-part cutting shaft arrangement.

In a refinement of the invention, the cutter support comprises two longitudinal members which extend at least approximately in the longitudinal direction of the vehicle, engage over the impact housing and are connected to each other on the end sides by a cross member. The cross member preferably defines the pivot axis for the cutting shaft arrangement in the impact housing. In an advantageous manner, the cross member is designed as a rotationally symmetrical hollow profile in which a support shaft, to which the impact housing and the cutting shaft arrangement mounted in the impact housing are connected in a rotationally fixed manner, is rotatably mounted.

In a further refinement of the invention, the cross member is assigned a support unit of the smoothing mechanism, which support unit is provided with the adjusting means for adjusting the smoothing mechanism. The support unit is used for supporting and securing the position of the smoothing mechanism.

In a further refinement of the invention, the support unit of the smoothing mechanism comprises at least one supporting arm which is mounted on the cross member in the manner of a rocker and which is assigned the at least one adjusting means. The at least partially flexible smoothing formation is also referred to as a finisher. The support unit can be of single- or multi-part design. In a particularly preferred embodiment of the invention, the support unit comprises a plurality of supporting arms which are distributed over the width of the smoothing mechanism and are mounted on the cross member of the cutter support. Mechanical adjusting screws are preferably provided as the adjusting means, which adjusting screws are arranged on the at least one supporting arm in such a manner that they can exert a pressure from above downwards onto a part of the smoothing formation, as a result of which, in particular, the curvature of the smoothing formation, the contact surface and the contact pressure can be changed. However, hydraulically or pneumatically acting adjusting means are also provided. The supporting arms are preferably held on the finisher in such a manner that tensile and also compressive loadings can be exerted on the finisher.

In a further refinement of the invention, the cutter support is assigned at least one oscillation damper which is arranged between a central coupling region, by means of which the piste grooming apparatus can be connected to the motor vehicle, and the cutter support. The at least one oscillation damper contributes to preventing the rear mounted implement, in particular the rear cutter, from swinging up during the driving mode of the track-laying vehicle. By this means, the quality of the preparation of the snow piste surface can be further improved.

In a further refinement of the invention, two oscillation dampers flanking the coupling region in a mirror-symmetrical manner are provided. The oscillation dampers are preferably used in order to compensate for oscillations of the rear mounted implement and in particular of the cutter support about an oscillation axis extending in the longitudinal direction of the vehicle. The oscillation dampers are advantageously designed in a manner such that they act hydraulically.

BRIEF DESCRIPTION OF THE DRAWINGS

Further advantages and features of the invention emerge from the claims and from the description below of preferred exemplary embodiments of the invention, which are illustrated with reference to the drawings.

DETAILED DESCRIPTION OF THE INVENTION

Figure 1:
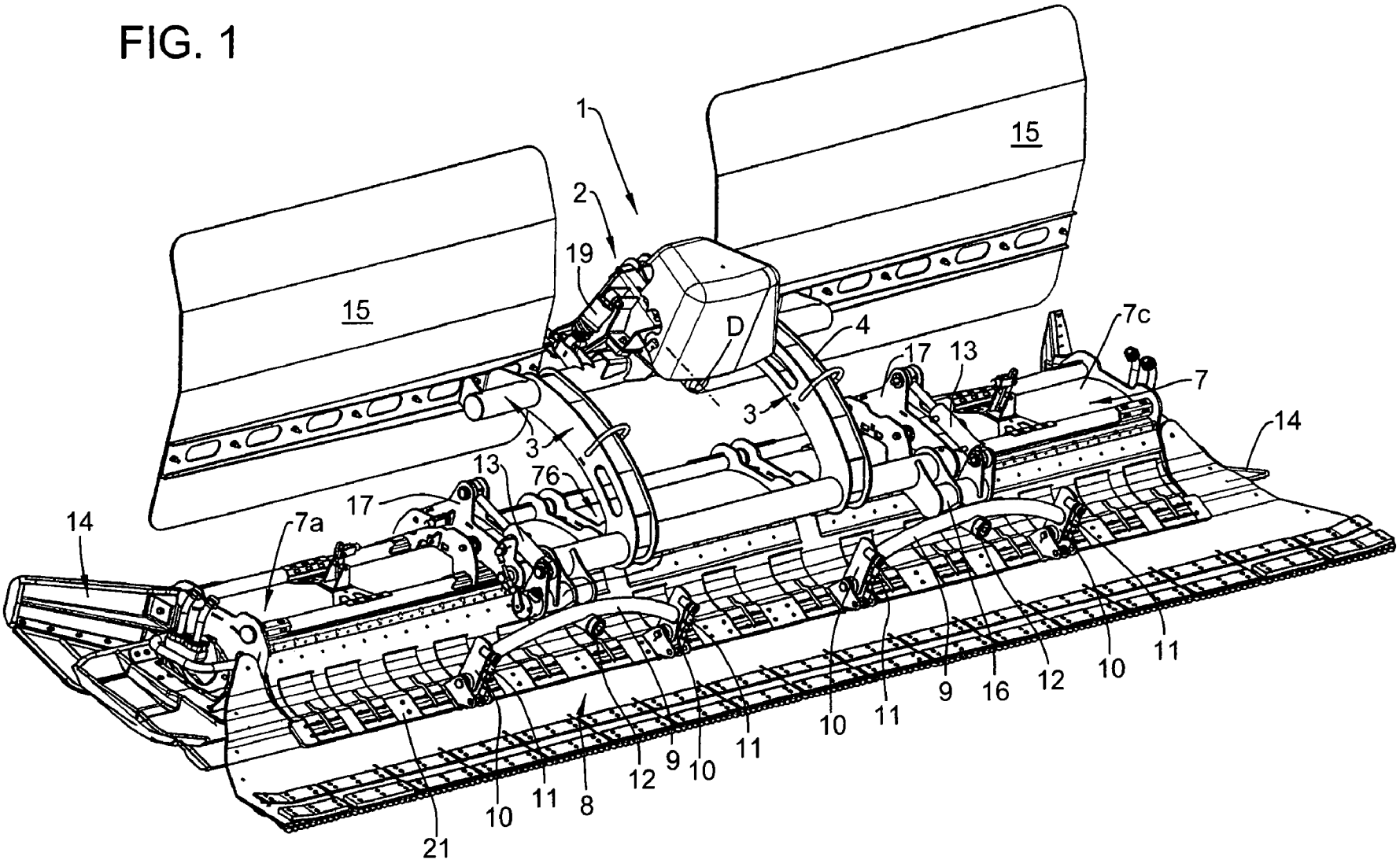
FIG. 1 shows, in a perspective illustration, a first embodiment of a piste grooming apparatus according to the invention.

A piste grooming vehicle in the form of a track-laying vehicle is used to fashion and to groom snow pistes. Such a track-laying vehicle is provided with a rear cutter 1 according to FIGS. 1 and 2, the rear cutter 1 constituting a rear mounted implement and therefore a piste grooming apparatus within the meaning of the invention. The rear cutter 1 is connected via a central coupling unit 2, which is basically known, to a corresponding coupling part in the form of a rear implement support on a rear of the track-laying vehicle. The rear cutter 1 is provided with hydraulic motors for a cutting shaft drive and with various hydraulic adjusting cylinders which are activated by a hydraulic system of the track-laying vehicle. For this purpose, the rear cutter 1, when mounted on the track-laying vehicle, is connected to the hydraulic system of the vehicle by means of corresponding hydraulic lines. The coupling of the rear cutter 1 to the vehicle rear and the hydraulic connection of the rear cutter 1 to the hydraulic system of the vehicle are known from the applicant's "PistenBully" track-laying vehicles, and therefore further details in this respect do not have to be entered into at this point.

The rear cutter 1 can be connected by the central coupling unit 2 to the rear implement support of the track-laying vehicle in a manner which is basically known. The rear cutter 1 has a cutter support 3 which is provided with the central coupling unit 2. The cutter support 3 is mounted in a manner such that it can at least slightly oscillate relative to the central coupling unit 2 about an axis of rotation D oriented approximately horizontally in the longitudinal direction of the vehicle. At side regions provided in a mirror-symmetrical manner with respect to a vertical central longitudinal plane, the central coupling unit 2 has receptacles for two oscillation dampers 19 which damp oscillations of the cutter support 3 relative to the central coupling unit 2 in particular about the axis of rotation D described. The oscillation dampers 19 are of hydraulic design and act by means of their lower regions on bearing brackets of a cross member 6 of the cutter support 3.

Figure 2:
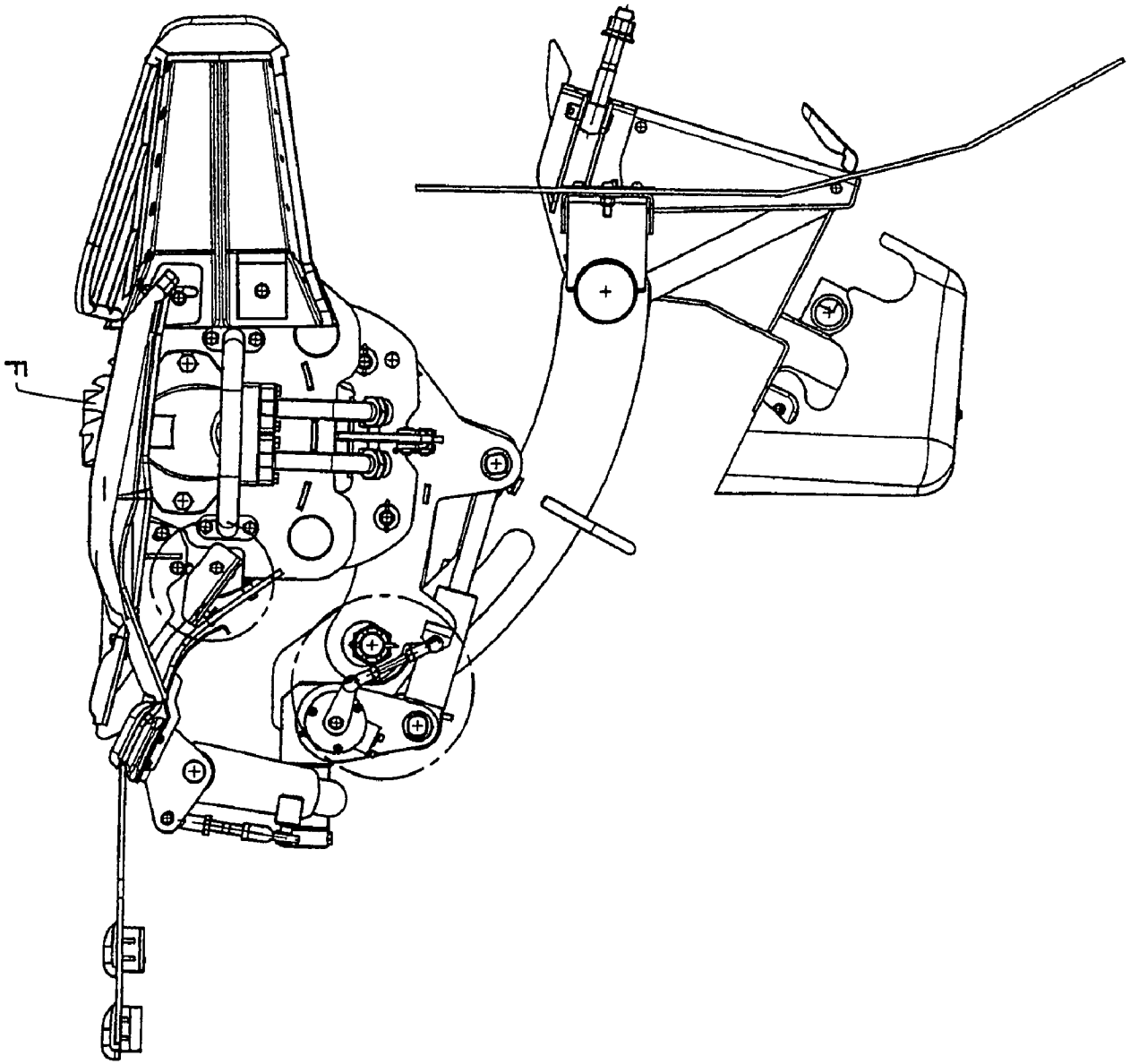
FIG. 2 shows a side view of the piste grooming apparatus according to FIG. 1.

The cutter support 3 has two longitudinal members 4 which—with reference to a forward direction of travel of the track-laying vehicle and of the rear cutter 1—extend to the rear and downward and are connected by their rear ends to a further cross member 5 which extends in the cutter transverse direction. The cross member 5 is designed as a rotationally symmetrical profile, in the present case as a cylinder profile. A pivot axis for a multi-part impact housing 7, in which a cutting shaft arrangement F which can be seen in FIG. 2 is mounted, is provided coaxially with respect to the cross member 5. The impact housing 7 has three parts 7*a*, 7*b*, 7*c* in which a respective cutting shaft is rotatably mounted. The three impact housing sections 7*a* to 7*c* are connected to one another via support profiles to form the common impact housing 7. The entire impact housing 7 including the multi-part cutting shaft arrangement F is mounted pivotably about a pivot axis, which is oriented coaxially with respect to the cross member 5, by means of a pivoting hydraulic system 13, 17. The pivot axis is positioned—as seen in the normal forward direction of travel of the track-laying vehicle and of the rear cutter 1—at a distance behind an axis of rotation of the cutting shaft arrangement F, part of which can be seen in FIG. 2. In addition, the pivot axis for the impact housing and the cutting shaft arrangement is offset upward in relation to the level of the axis of rotation of the cutting shaft arrangement F. The pivot axis for the impact housing and cutting shaft arrangement is therefore positioned both to the rear and also offset upward with respect to the axis of rotation of the cutting shaft arrangement F.

The pivoting hydraulic system 13, 17 has two hydraulic cylinders 13 which are arranged on bearing brackets 16 which are connected fixedly to the cross member of the cutter support 3 (FIG. 1). The hydraulic cylinders 13 act on support profiles 17 which are designed in the manner of bridges and upwardly surround the impact housing 7. The longitudinal members 4 of the cutter support extend above and beyond the impact housing 7, as can be seen with reference to FIGS. 1 and 2. The entire impact housing 7 including the cutting shaft arrangement F within the impact housing is therefore at least substantially pivotable about a central longitudinal axis of the cross member 5 of the cutter support 3. owing to the fact that this pivot axis is positioned behind the impact housing 7, a pivoting movement essentially results in a lifting or lowering movement of the impact housing, which movement defines the cutting depth for the cutting shaft arrangement. The cutting shaft arrangement F is pushed by means of the suspension, which is located behind its axis of rotation, of the impact housing 7 through the snow and/or ice surface to be prepared.

In addition, two supporting arms 9 are mounted on the bearing brackets 16, which are designed as support extensions, of the cross member 5, which supporting arms are arranged on that side of the bearing brackets 16 which faces away from the impact housing. Each supporting arm 9 is designed in the manner of a rocker and is mounted pivotably to a limited extent centrally in the region of a pivot axis 12 directed approximately in the longitudinal direction of the rear cutter 1 and therefore approximately in the longitudinal direction of the vehicle. The two supporting arms 9 are fastened in the region of their lateral ends to support webs 10 which are coupled to a dimensionally stable support bar 21 of a finisher 8 of a smoothing mechanism. The finisher 8 extends over the entire width of the rear cutter 1 and is designed as a continuous, flexible smoothing formation. The finisher 8 adjoins the rear side of the impact housing 7. The support bar 21 is connected in a positive-locking and sheetlike manner to the finisher 8 and extends over virtually the entire width—as seen in the transverse direction of the rear cutter 1—of the finisher 8. The support bar 21 is held on the supporting arms 9 in a manner such that it can pivot about a pivot axis, which is oriented parallel to the axis of rotation of the cutting shaft arrangement F, in the region of the four support webs 10 in total. In order to be able to change the pivoting position of the support bar 21 and therefore also of the finisher 8 relative to the supporting arms 9 and, in particular, the support webs 10 and to be able to ensure desired pivoting angles and pivoting positions, adjusting means in the form of small mechanical adjusting screws 11 are provided, the adjusting screws extending along each support web 10 and being supported firstly on the support web 10 and therefore also on the supporting arm 9 and secondly on the support bar 21. The support bar 21 can be adjusted in its angle relative to the supporting arms 9 by appropriate adjustment of said adjusting screws 11, and therefore the finisher 8 can be positioned in a corresponding manner at a steeper or more shallow angle.

The finisher 8 extends beyond the width of the impact housing 7 to both sides of the vehicle. A respective side finisher 14 is provided on the end sides of the impact housing 7 and, in a basically known manner, smoothes snow or ice edges which have been thrown up laterally. The finisher 8 produces the final finishing in these edge regions behind the side finishers 14 of the piste surface.

Laterally outwardly protruding snow catchers 15 are provided on the cutter support 3 and are intended to prevent snow which has been hurled up on the rear side by the tracks during operation of the track-laying vehicle from flying over the rear cutter 1 and thereby reducing the quality of the piste surface prepared by the rear cutter 1 or clogging up the upper side of the rear cutter 1 with snow.

Figure 3:
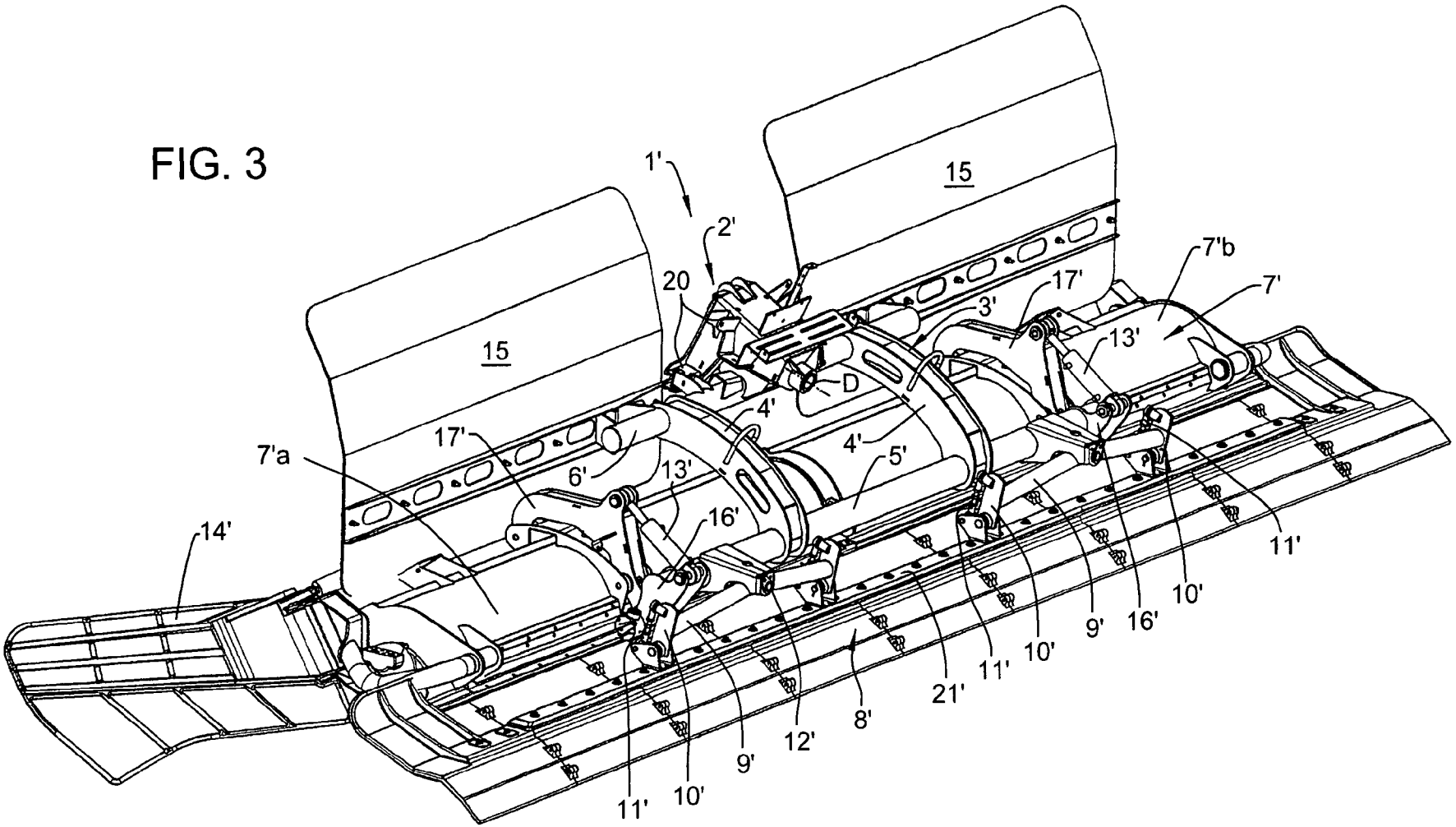
FIG. 3 shows, in a perspective illustration, a further embodiment of a piste grooming apparatus according to the invention.
Figure 4:
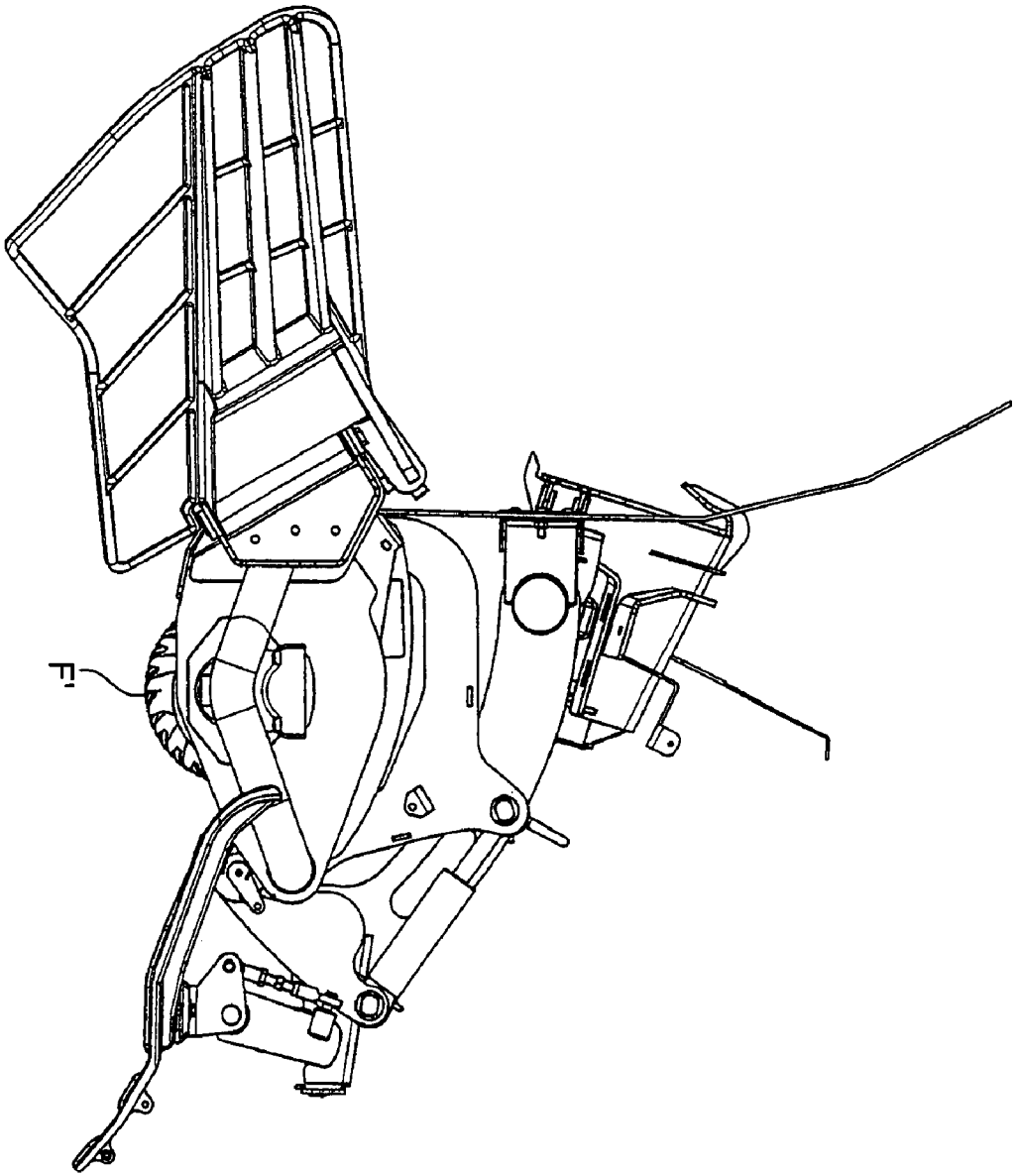
FIG. 4 shows a side view of the piste grooming apparatus according to FIG. 3.

The embodiment according to FIGS. 3 and 4 is of identical design with regard to its functional construction to the rear cutter 1 according to FIGS. 1 and 2. Functionally identical parts and sections of the rear cutter 1' are provided with identical reference numbers with the addition of the sign "'". An essential difference is that both the impact housing 7' and the cutting shaft arrangement F' are merely of two-part design and not three-part design, as was the case in the embodiment according to FIGS. 1 and 2. To avoid repetitions, reference is therefore made to the description of the embodiment according to FIGS. 1 and 2. The rear cutter 1' also has an impact housing 7' and a cutting shaft arrangement F', which are mounted on the cutter support 3' in a manner such that they can pivot about a pivot axis arranged behind the axis of rotation of the cutting shaft arrangement F'. The cutting shaft arrangement F' is therefore also pushed by the rear introduction of force via the cutter support 3' during the driving mode of the track-laying vehicle. As per the embodiments according to FIGS. 1 and 2, the cutter support 3' is provided with two oscillation dampers (not illustrated) which are arranged on corresponding bearing brackets 20 in the region of the central coupling unit 2' and in the region of the upper cross member 6' of the cutter support 3'. For reasons of clarity, the covering of the central coupling unit 2' is not illustrated. It can be seen with reference to FIGS. 3 and 4 that the various parts of the rear cutter 1' are of functionally identical design. Only the structural design differs in detail, as is apparent with reference to FIGS. 3 and 4. In addition, in the case of the rear cutter 1', the adjusting cylinders 11' are not arranged behind the support webs 10', as is the case in the embodiment according to FIGS. 1 and 2, but rather are arranged in front of the support webs 10, in the forward direction of travel. This results in a reverse coupling of the support bar 21' of the finisher 8' without, however, the adjustment function for the finisher 8' changing.

The side finishers 14' also differ structurally and extend further laterally outward in relation to the side edges of the finisher 8'. Reference is made to FIGS. 3 and 4 with respect to further structural details of the rear cutter 1'. All of the technical features which can be seen there are essential to the invention. This applies in the same manner to the illustrations in FIGS. 3 and 4.

The supporting arms 9, 9' of the support unit for the finisher 8, 8', which supporting arms are movable to a limited extent in the manner of a rocker about the pivot axes 12, 12' extending approximately in the longitudinal direction of the vehicle when the rear cutter is oriented rectilinearly during the driving mode, are mounted on support extensions of the cross member 5, 5', which are connected rigidly to the cross member 5, 5' and therefore constitute parts of the cross member and of the cutter support. The position of the pivot axis 12, 12' for the supporting arms 9, 9' therefore does not change in relation to the cutter support 3, 3', to be precise irrespective of whether the impact housing 7, 7' and the respectively held cutting shaft arrangement F, F' are adjusted relative to the cutter support 3, 3' or not. The support bar 21, 21', which is crucial to the orientation of the finisher 8, 8' is held at least essentially rigidly relative to the cutter support 3, 3' by means of the mechanical adjusting screws 11, 11' and the support webs 10, 10', and therefore, if the need arises, pivoting of the impact housing 7, 7' and of the cutting shaft arrangement F, F' results in that section of the finisher 8, 8' which is located in front of the support bar 21, 21' in the normal direction of travel being moved at the same time. The smoothing function of the finisher 8, 8' is therefore independent of the pivoting position of the impact housing 7, 7' and of the cutting shaft arrangement F, F'.

What is claimed is:

1. Piste grooming apparatus for a motor vehicle for use in a forward direction of travel of the motor vehicle, with a cutter support which can be adjusted relative to the motor vehicle about a plurality of axes and which has a cutting shaft arrangement arranged rotatably in an impact housing, and with a smoothing mechanism which, relative to the forward direction, is arranged behind the cutting shaft arrangement and is held in an adjustable manner by means of at least one adjusting means, wherein the impact housing and the cutting shaft arrangement are pivotally mounted on the cutter support about a pivot axis which, relative to the forward direction, lies behind an axis of rotation of the cutting shaft arrangement, and wherein the smoothing mechanism is supported by a support unit having supporting arms mounted on support extensions of a cross member, the support extensions being rigidly connected to the cross member, and the supporting arms being movable to a limited extent in the manner of a rocker about a pivot axis extending parallel to the forward direction of travel of the motor vehicle when the cutter is oriented rectilinearly during the driving mode.

2. Piste grooming apparatus according to claim 1, wherein the cutter support comprises two longitudinal members which extend at least approximately in the longitudinal direction of the vehicle, engage over the impact housing and are connected to each other on end sides by the cross member.

3. Piste grooming apparatus according to claim 1, wherein the cutter support is assigned at least one oscillation damper which is arranged between a central coupling region, by means of which the piste grooming apparatus can be connected to the motor vehicle, and the cutter support.

4. Piste grooming apparatus according to claim 3, wherein said at least one oscillation damper comprises two oscillation dampers flanking the coupling region in a mirror-symmetrical manner.

5. Piste grooming apparatus according to claim 4, wherein said two oscillation dampers are designed in a manner such that they act hydraulically.

* * * * *